US006648729B2

(12) United States Patent
Lai et al.

(10) Patent No.: US 6,648,729 B2
(45) Date of Patent: Nov. 18, 2003

(54) WAFER PRESSURE REGULATION SYSTEM FOR POLISHING MACHINE

(75) Inventors: Chien-Hsin Lai, Kaohsiung Hsien (TW); Cheng-Chi Hsieh, Chu-Dung (TW); Jung-Nan Tseng, Hsinchu Hsien (TW); Huang-Yi Lin, Taichung Hsien (TW); Fu-Yang Yu, Hsinchu (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 10/172,308

(22) Filed: Jun. 14, 2002

(65) Prior Publication Data

US 2003/0022595 A1 Jan. 30, 2003

(30) Foreign Application Priority Data

Jul. 24, 2001 (TW) ..... 90118009 A

(51) Int. Cl.[7] ..... B25B 51/00

(52) U.S. Cl. ..... 451/5; 451/285; 451/287

(58) Field of Search ..... 451/5, 8, 9, 10, 451/11, 41, 285, 287, 282, 398; 156/345.13; 438/692, 693

(56) References Cited

U.S. PATENT DOCUMENTS 6,520,835 B1 * 2/2003 Sato et al. ..... 451/8
6,572,441 B2 * 6/2003 Lukner et al. ..... 451/5

* cited by examiner

*Primary Examiner*—Joseph J. Hail, III
*Assistant Examiner*—Hadi Shakeri
(74) *Attorney, Agent, or Firm*—J.C. Patents

(57) ABSTRACT

A controlled pressure regulation system generates the wafer-pressing pressures during a polishing operation. A wafer carrier head holds a wafer to be polished against a platen. A first and second pressure regulators respectively generate a first and second pressure onto the platen and the wafer carrier head to press the wafer to be polished. A first and second controllers are respectively connected to the first and second pressure regulators in control feedback loops to control the generation of the first and second pressures. The first and second pressures are controlled to obtain a desired difference of pressure between the first and second pressure.

9 Claims, 3 Drawing Sheets

WAFER PRESSURE REGULATION SYSTEM FOR POLISHING MACHINE

CROSS-REFERENCE TO RELATED APPLICATION

This application claims the priority benefit of Taiwan application serial no. 90118009, filed Jul. 24, 2001.

BACKGROUND OF THE INVENTION

1. Field of the Invention

The invention relates to a polishing machine. More particularly, the present invention relates to a pressure regulation system used in a polishing machine.

2. Description of the Related Art

In semiconductor manufactures, integrated circuits are conventionally formed on substrates, particularly silicon wafers, by the successive depositions of conductive, insulative, or semiconductive layers. After a layer is deposited, the layer generally is etched to remove material from selected regions to create the desired circuitry features. As the number of deposited and etched layers increases, the topmost surface of the substrate successively becomes less planar because the distance between the topmost surface and the underlying substrate is the greatest at the least etched regions while it is the least at the greatest etched regions.

A non-planar upper surface is problematic when a photolithography is to be performed to pattern a layer deposited over the substrate. For example, the accuracy of the pattern transfer onto the layer critically depends on the planarity of the upper surface of the layer and is ensured only if the layer surface is not irregular, which otherwise may scatter the light during exposure. Therefore, the surface of the substrate needs to be periodically planarized to provide a relatively flat and smooth layer surface. Polishing methods such as chemical mechanical polishing method are methods known in the art.

Referring to FIG. 1, a simplified diagram schematically shows a conventional polishing machine. The structure of a conventional polishing machine comprises a wafer carrier head 10 rotary and slidably mounted, a platen 18 rotary mounted, and a polishing pad 22 fixedly arranged on the platen 18. To perform a polishing, a substrate, for example a wafer, is fixedly mounted on the wafer carrier head 10 by means of for example an adhesive layer 20. By means of a pressure P1 and a pressure P2, the platen 18 and the wafer carrier head 10 respectively press the wafer against each other. While the to be-planarized surface of the wafer is thus pressed against the polishing pad 22, the wafer carrier head 10 and/or the platen 18 move relative to each other to generate a relative motion between the wafer and the polishing pad 22. During polishing, a polishing slurry including an abrasive suspended in a liquid and at least one chemically-reactive agent for chemical mechanical polishing is regularly applied onto the polishing pad 22 to provide an abrasive and chemically reactive mixture at the wafer-polishing pad interface.

To obtain an adequate polishing of the wafer, many factors such as the relative speed between the polishing pad and the wafer, the total polishing time, and the pressure applied during polishing must be considered. With respect to the control of the pressure applied during polishing, various specific structures of the wafer carrier head are known in the art.

U.S. Pat. No. 5,584,751 issued to Kobayashi et al. discloses a wafer carrier head that improves the polishing uniformity by applying various pressures to a wafer carrier head. In U.S. Pat. No. 5,584,751, a first pressure applied to a diaphragm presses a wafer carrier holding a wafer against a polishing pad while a second pressure is applied to a retainer ring that presses against the polishing pad at an outer periphery of the wafer.

U.S. Pat. No. 6,143,123 issued to Robinson et al. discloses a polishing machine that includes a pressure sensor embedded in the polishing pad to measure the pressure at various areas of the surface of the wafer being polished. Via the sensing of the pressure, a plurality of actuators adjust an adequate pressure during the polishing.

By means of various technical arrangements, these patents provide improvements of the polishing by emphasizing one aspect: the pressure applied during polishing. However, the prior art references neither disclose nor solve an overshoot problem that occurs when the wafer is pressed between the polishing pad and the wafer carrier head, as described hereafter. Still with reference to FIG. 1 and as described above, to perform a planarization, the wafer is pressed between the wafer carrier head 10 and the platen 18 by means of first and second pressures P1 and P2 respectively applied on the platen 18 and the wafer carrier head 10. Practically, a tight maintain of the wafer is ensured only at the condition that the first pressure P1 is greater than the second pressure P2 within an adequate range, in other words the difference of pressure $\Delta P = P2 - P1 < 0$. During a planarization operation, the operator thus sets the first and second pressures P1 and P2 such that the difference of pressure $\Delta P$ is constantly equal to a predetermined negative value. However, before attaining a steady state where $\Delta P$ is constant, a relatively high peak overshoot usually occurs during a transient response of $\Delta P$. This overshoot means an excessive difference of pressure $\Delta P$ that may damage the wafer and cause instability of the pressure regulation system.

SUMMARY OF THE INVENTION

A major aspect of the present invention is to provide a controlled pressure regulation system for polishing machine and a method for regulating the wafer pressing pressures in a polishing machine that prevents damages of the wafer to be polished.

To accomplish at least the above objectives, the present invention provides a controlled pressure regulation system that comprises the following elements. A wafer carrier head holds a wafer to be polished against a platen. A first pressure regulator generates a first pressure onto the platen and a second pressure regulator generates a second pressure onto the wafer carrier head to press the wafer to be polished between the platen and the wafer carrier head. A first controller is connected to the first pressure regulator in a first feedback loop to control the generation of the first pressure onto the platen. A second controller is connected to the second pressure regulator in a second feedback loop to control the generation of the second pressure onto the wafer carrier head according to the difference between the difference between the first pressure and the second pressure. The control of the generation of the first and second pressures, preferably performed by proportional integral controllers, prevents peak overshoot of the difference of pressure between the first pressure and second pressure, which consequently prevents damages of the wafer to be polished.

The present invention further provides a method of pressure regulation applied during a polishing to press a wafer to be polished between a wafer carrier head and a platen. The method comprises the following steps. A first pressure is generated onto the platen. The generation of the first pressure onto the platen is controlled by a first control feedback loop. A second pressure is generated onto the wafer carrier head. The generation of the second pressure is controlled according to a difference of pressure between the first and second pressure via a second control feedback loop.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

The following detailed description of the embodiments and examples of the present invention with reference to the accompanying drawings is only illustrative and not limiting.

Figure 1:
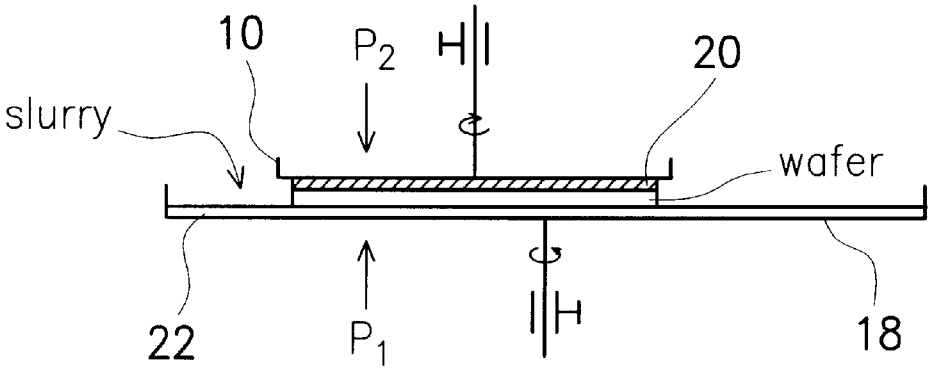
FIG. 1 (PRIOR ART)
FIG. 1 is a cinematic diagram illustrating the operation of a conventional polishing machine.
Figure 2:
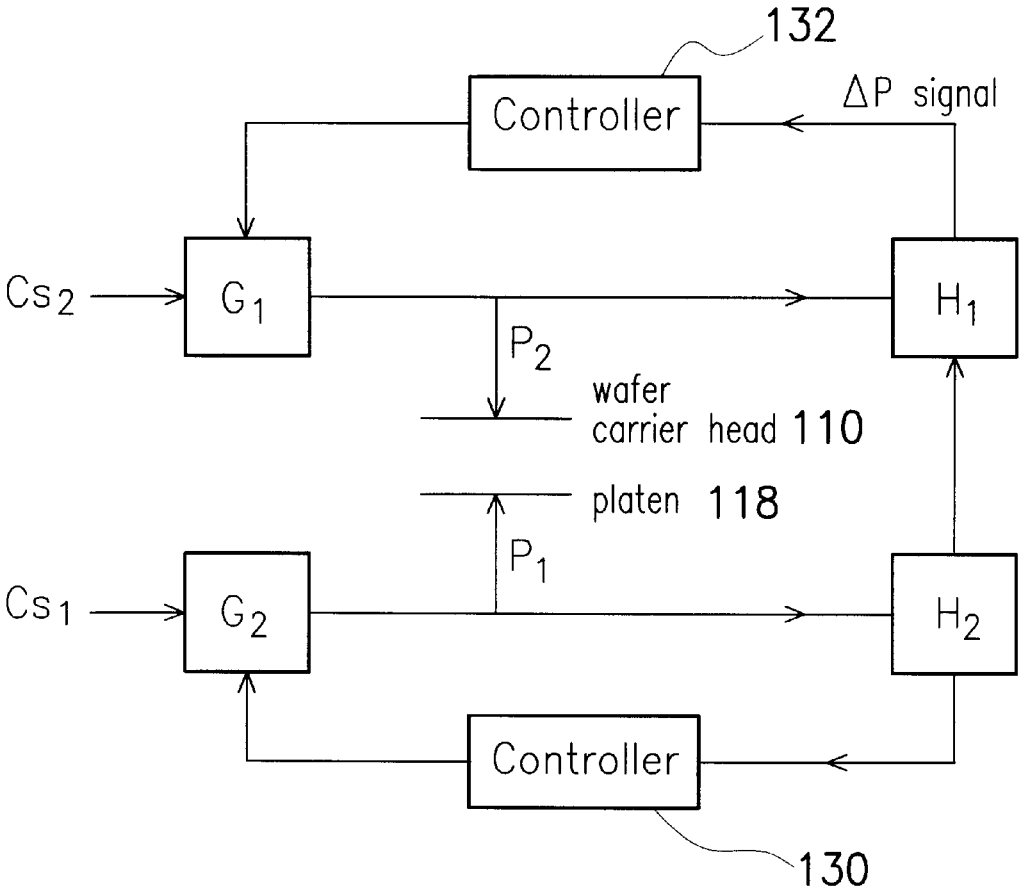
FIG. 2 is a block diagram of a controlled pressure regulation system used in a polishing machine according to an embodiment of the present invention.

Referring now to FIG. 2, a block diagram schematically illustrates a controlled pressure regulation system according to a preferred embodiment of the present invention. To press a wafer to be polished (not shown), a first pressure regulator G1 generates a first pressure P1 on a platen 118 from a pressure command signal Cs1 while a second pressure regulator G2 generates a second pressure P2 on a wafer carrier head 110 from a pressure command signal Cs2. The pressure command signals Cs1 and Cs2 can be, for example, adequate tensions inputted to the pressure regulators G1 and G2.

In a first control feedback loop, a first transducer H1 and a first controller 130 are sequentially arranged to control the generation of the first pressure P1 performed by the first pressure regulator G1. The first transducer H1 converts the first pressure onto the platen 118 into an electric signal delivered to the first controller 130.

In a second control feedback loop, a second transducer H2 and a second controller 132 are sequentially arranged to control the generation of the second pressure P2 performed by the second pressure regulator G2. The generation of the second pressure P2 is controlled according to a difference of pressure ΔP between the first pressure P1 and the second pressure P2. The difference of pressure ΔP is evaluated by, for example, the second transducer H2 connected to the first transducer H1. An electric signal representation of the difference of pressure ΔP is delivered from the second transducer H2 to the second controller 132.

Through an adequate design of the first and second controllers 130 and 132, respectively connected to the first and second pressure regulators G1 and G2, an overshoot of the difference of pressure ΔP between the first pressure P1 and the second pressure P2 can be reduced.

Figure 3:
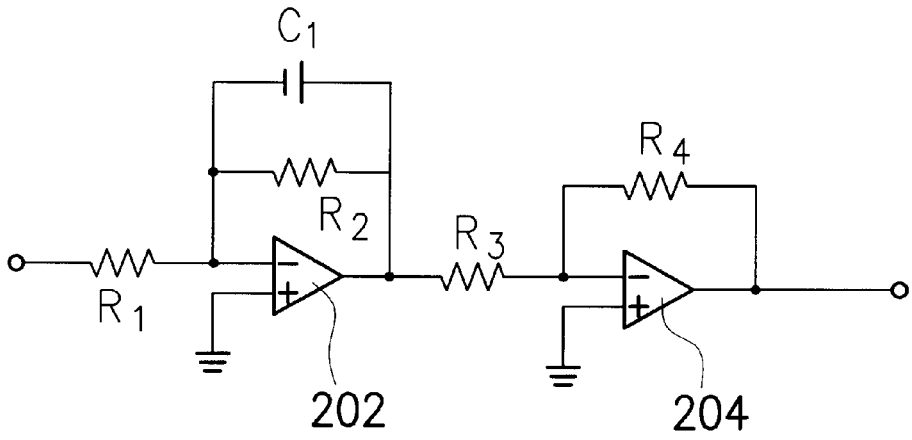
FIG. 3 and FIG. 4 are circuit diagrams of controllers used in the controlled pressure regulation system of FIG. 2 according to an embodiment of the present invention.
Figure 4:
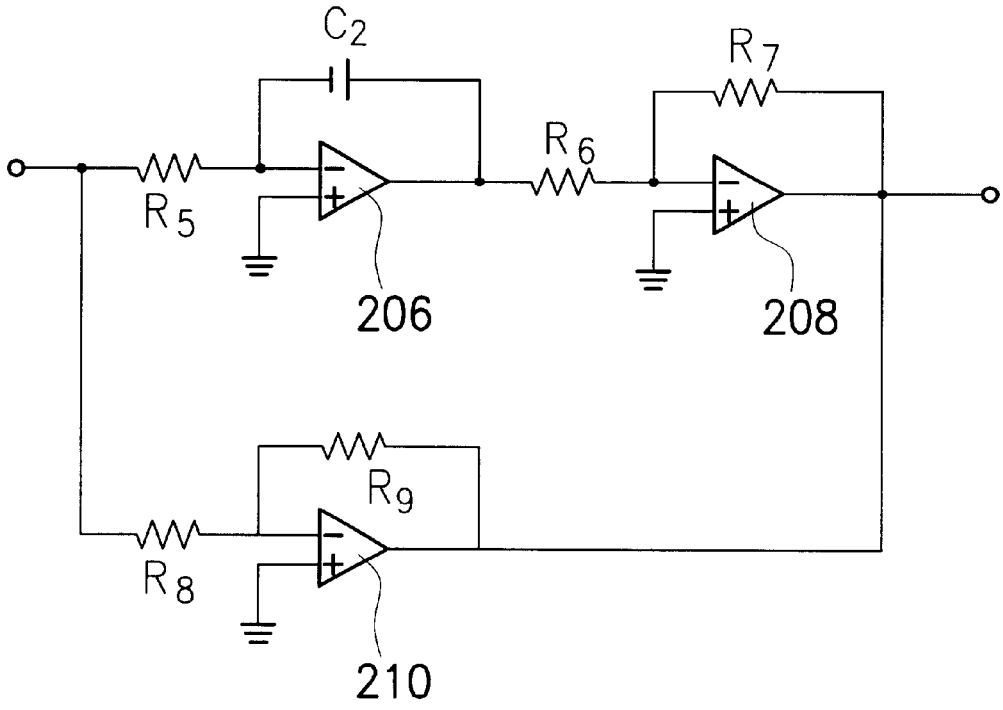

Referring now to FIG. 3 and FIG. 4, two circuit diagrams respectively show the design of the first and second controllers 130 and 132 according to a preferred embodiment of the present invention. The first and second controllers are preferably proportional integral (PI) controllers. With reference to FIG. 3, the first PI controller 130 comprises a first operational amplifier 202 in integrator configuration and a second operational amplifier 204 in inverting configuration. The positive input and negative input of the first operational amplifier 202 in integrator configuration are respectively connected to the ground and a first resistor R1 while a capacitor C1 in parallel with a second resistor R2 connects the output to the negative input in the feedback loop. The positive input and negative input of the second operational amplifier 204 in inverting configuration are respectively connected to the ground and a third resistor R3 while a fourth resistor R4 connects the output to the negative input in the feedback loop. The third resistor R3 connects the negative input of the second operational amplifier 204 in inverting configuration to the output of the first operational amplifier 202 in integrator configuration. The input of the first PI controller 130 connects to the first resistor R1 while the output of the first PI controller 130 connects to the output of the second operational amplifier 204 in inverting configuration.

The transfer function of a PI controller conventionally is $[K_p+K_I/s]$, wherein $K_p$, $K_I$ are respectively the proportional gain and the integral gain and s is a complex variable. In an example of implementation of the present embodiment, the capacitor C1 and different resistors of the first PI controller 130 are set as follows.

R1=100KΩ;

R2=15 KΩ;

R3=R4=10 KΩ; and

C1=0.2 μF.

Thus, $K_p$=(−R2/R1) (−R4/R3)=0.15 and $K_I$=(−1/R1C1) (−R4/R3)=50.

With reference to FIG. 4, the second PI controller 132 comprises a third operational amplifier 206 in integrating configuration, a fourth operational amplifier 208 in inverting configuration, and a fifth operational amplifier 210 in inverting configuration. The positive input and negative input of the third operational amplifier 206 in integrating configuration are respectively connected to the ground and a fifth resistor R5 while a second capacitor C2 connects the output to the negative input in the feedback loop. The positive input and the negative input of the fourth operational amplifier 208 (or respectively fifth operational amplifier 210) are respectively connected to the ground and a sixth resistor R6 (or respectively eighth resistor R8) while a seventh resistor R7 (or respectively ninth resistor R9) connects the output to the negative input. The sixth resistor R6 further connects the negative input of the fourth operational amplifier 208 in inverting configuration to the output of the third operational amplifier 206 in integrating configuration. The input of the second PI controller 132 connects the fifth resistor R5 to the eighth resistor R8 while the output of the second PI controller 132 connects the output of the fourth operational amplifier 208 inverting configuration to the output of the fifth operational amplifier 210 in inverting configuration. In an example of implementation, the capacitor C2 and different resistors of the second PI controller 132 are set as follows.

R5=R6=R7=R8=10KΩ;

R9=5 KΩ; and

C2=0.285 μF.

Thus, $K_p$=(−R9/R8)=−0.5 and $K_I$=(−1/R5C2) (−R7/R6)=350 for the second PI controller 132.

Figure 5:
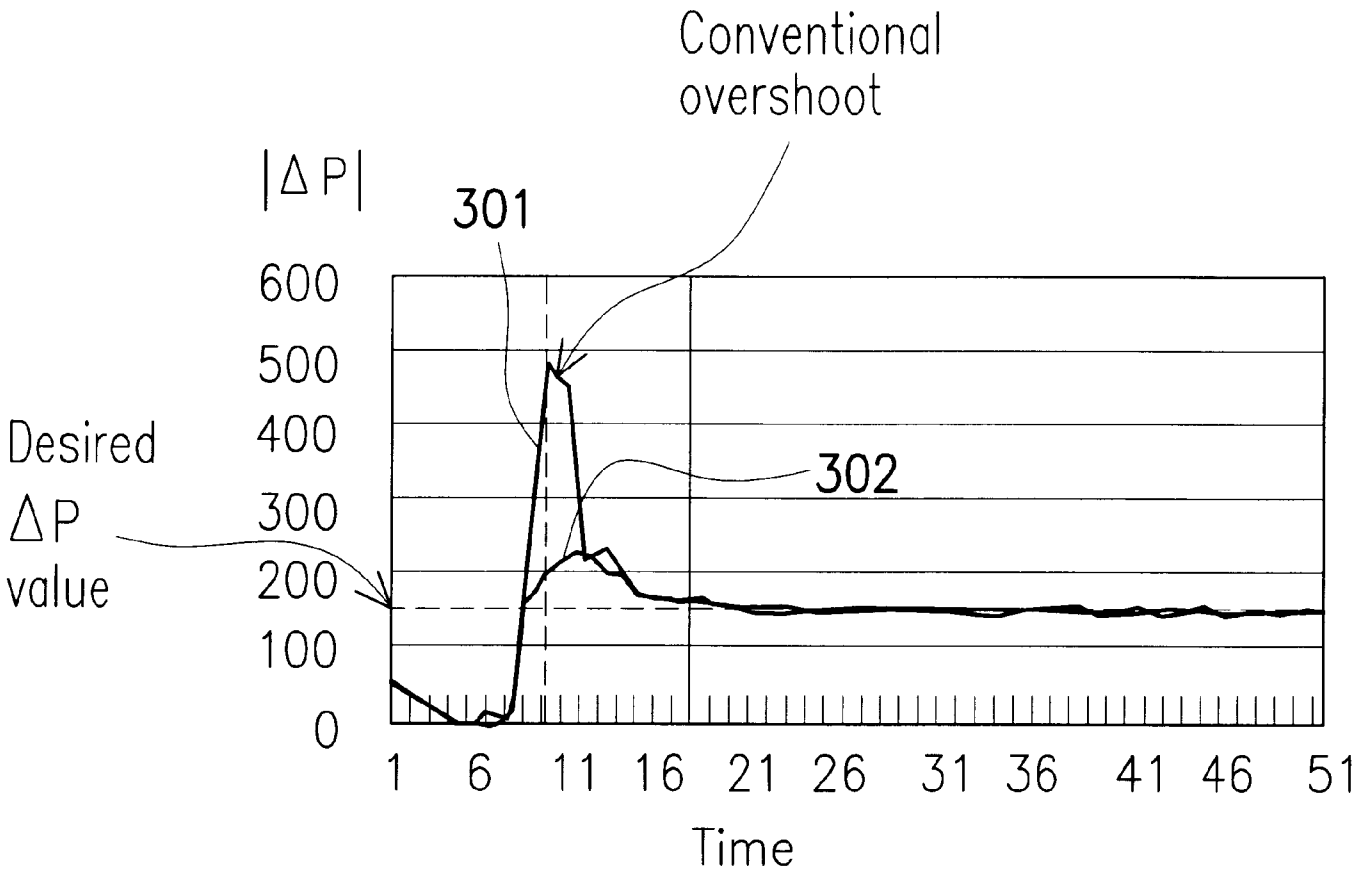
FIG. 5 is a graph that compares the difference of pressure in time obtained by the prior art and the present invention.

Referring now to FIG. 5, a graph schematically compares the difference of pressure ΔP in time obtained by the prior art and the present invention. More particularly, the ordinate axis represents the absolute value of the difference of pressure |ΔP| and the abscissa axis represents the time, the unit of each axis is arbitrary. The graph plots the variation in time of the absolute value |ΔP| obtained by the conventional pressure regulation system (see plot 301) and the controlled pressure regulation system of the present invention (see plot 302). In the graph, the desired value of |ΔP| for pressing the wafer is for example 150. At the time 6, the output of the pressure command signals commands the generation of the first and second pressures P1 and P2 to press the wafer between the wafer carrier head and the platen. With the conventional pressure regulation system, a relatively high peak overshoot occurs in the interval of time [6; 16] of the transient response. A steady state of the response |ΔP| at the targeted value 150 is obtained after the time 16. The conventional overshoot of the response |ΔP| attains 500, which is approximately 3.5 times the targeted value 150.

In contrast, with the controlled pressure regulation system of the present invention, the overshoot is substantially reduced to approximately 220, which is approximately 1.5 times the targeted value 150. The controlled pressure regulation system of the present invention thus advantageously prevents damages of the wafer by substantially reducing the overshoot of the transient response.

In conclusion, the advantages of the present invention at least include the following aspects. The controlled pressure regulation system of the present invention comprises control feedback loops that incorporate PI controllers therein. An adequate design of the PI controllers ensures a stability of the controlled pressure regulation of the present invention, and prevents wafer damages due to overshoot problem.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A controlled pressure regulation system suitable for use in a polishing machine, the controlled pressure regulation system comprising:

a wafer carrier head that holds a wafer to be polished;

a platen against which is pressed the wafer to be polished;

a first pressure regulator that generates a first pressure onto the platen to press the wafer to be polished against the wafer carrier head;

a second pressure regulator that generates a second pressure onto the wafer carrier head to press the wafer to be polished against the platen;

a first controller connected to the first pressure regulator in a first feedback loop to control the generation of the first pressure onto the platen; and a second controller connected to the second pressure regulator in a second feedback loop to control the generation of the second pressure onto the wafer carrier head according to a difference of pressure between the first pressure and the second pressure.

2. The controlled pressure regulation system of claim 1, wherein the first and second controllers are proportional integral controllers.

3. The controlled pressure regulation system of claim 1 further comprising a plurality of means for converting the first and second pressures into electric signals delivered to the first and second controllers.

4. A controlled pressure regulation system suitable for use in a polishing machine that comprises a wafer carrier head for holding a wafer to be polished and a platen against which is pressed the wafer to be polished, the controlled pressure regulation system comprising:

a first pressure regulator that generates a first pressure onto the platen to press the wafer against the wafer carrier head;

a second pressure regulator that generates a second pressure onto the wafer carrier head to press the wafer against the platen;

a first proportional integral controller connected to the first pressure regulator in a first feedback loop to control the generation of the first pressure onto the platen;

a second proportional integral controller connected to the second pressure regulator in a second feedback loop to control the generation of the second pressure onto the wafer carrier head according to a difference of pressure between the first and second pressures;

the first proportional integral controller further including a first operational amplifier in integrating configuration and a second operational amplifier in inverting configuration; and the second proportional integral controller further including a third operational amplifier in integrating configuration and fourth and fifth operational amplifiers in inverting configuration.

5. The controlled pressure regulation system of claim 4, wherein the proportional gain and the integral gain of the first proportional integral controller are respectively 0.15 and 50 while the proportional gain and the integral gain of the second proportional integral controller are respectively −0.5 and 350.

6. The controlled pressure regulation system of claim 4 further comprising a plurality of means for converting the first and second pressures into electric signals delivered to the first and second proportional integral controllers.

7. A method of pressure regulation applied during a polishing to press a wafer to be polished between a wafer carrier head and a platen, the method comprising:

generating a first pressure onto the platen;

controlling the generation of the first pressure onto the platen via a first control feedback loop;

generating a second pressure onto the wafer carrier head; and controlling the generation of the second pressure onto the wafer carrier head according to a difference of pressure between the first and second pressure via a second control feedback loop.

8. The method of claim 7, wherein the first control feedback loop comprises a first proportional integral controller which proportional gain and integral gain are respectively 0.15 and 50 while the second control feedback loop comprises a second proportional integral controller which proportional gain and integral gain are respectively −0.5 and 350.

9. The method of claim 8, wherein the first and second control feedback loops respectively comprises a means for converting respectively the first and second pressures into electric signals.

* * * * *